US010981392B2

(12) United States Patent
Kurosu et al.

(10) Patent No.: US 10,981,392 B2
(45) Date of Patent: Apr. 20, 2021

(54) LIQUID EJECTION HEAD AND METHOD OF MANUFACTURING LIQUID EJECTION HEAD

(71) Applicant: CANON KABUSHIKI KAISHA, Tokyo (JP)

(72) Inventors: Toshiaki Kurosu, Kamakura (JP); Takanobu Manabe, Oita (JP); Kenji Fujii, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 33 days.

(21) Appl. No.: 16/425,052

(22) Filed: May 29, 2019

(65) Prior Publication Data

US 2020/0009875 A1 Jan. 9, 2020

(30) Foreign Application Priority Data

Jul. 4, 2018 (JP) ..... JP2018-127514

(51) Int. Cl.

| | |
|---|---|
| ***B41J 2/175*** | (2006.01) |
| ***B41J 2/16*** | (2006.01) |
| *B41J 2/14* | (2006.01) |

(52) U.S. Cl.

CPC ..... *B41J 2/17563* (2013.01); *B41J 2/1601* (2013.01); *B41J 2/1607* (2013.01); *B41J 2/1628* (2013.01); *B41J 2/14145* (2013.01); *B41J 2002/14403* (2013.01)

(58) Field of Classification Search

CPC .... B41J 2/17563; B41J 2/1607; B41J 2/1601; B41J 2/1628; B41J 2/1645; B41J 2/14145; B41J 2/14129; B41J 2002/14403

See application file for complete search history.

(56) References Cited

U.S. PATENT DOCUMENTS

| | | | | |
|---|---|---|---|---|
| 7,287,847 | B2 | 10/2007 | Fujii et al. | |
| 7,753,502 | B2 | 7/2010 | Fujii et al. | |
| 7,862,158 | B2 | 1/2011 | Fujii et al. | |
| 7,901,064 | B2 | 3/2011 | Urayama et al. | |
| 8,047,632 | B2 | 11/2011 | Fujii et al. | |
| 8,544,997 | B2 | 10/2013 | Kurosu et al. | |
| 8,608,303 | B2 * | 12/2013 | Murayama | B41J 2/1629 347/93 |
| 2003/0156162 | A1 * | 8/2003 | Hirota | B41J 2/14233 347/66 |

(Continued)

FOREIGN PATENT DOCUMENTS

JP 2005-178364 A 7/2005

*Primary Examiner* — John Zimmermann

(74) *Attorney, Agent, or Firm* — Venable LLP

(57) ABSTRACT

Provided are a liquid ejection head capable of preventing deformation and breakage of a filter and a method of manufacturing the liquid ejection head. The liquid ejection head comprises: a substrate comprising a supply port through which to supply a liquid and an element configured to produce energy for ejecting the liquid; a resin layer comprising an ejection port through which the liquid is ejectable with the energy produced by the element, and a flow channel connecting the supply port and the ejection port; a filter disposed between the supply port and the flow channel; and a support portion supporting a surface of the filter on the supply port side and a surface of the filter on the flow channel side.

8 Claims, 3 Drawing Sheets

(56) References Cited

U.S. PATENT DOCUMENTS

| | | | | |
|---|---|---|---|---|
| 2006/0017785 | A1* | 1/2006 | Park | B41J 2/14145 347/61 |
| 2007/0252872 | A1* | 11/2007 | Fujii | B41J 2/1635 347/63 |
| 2012/0242747 | A1* | 9/2012 | Kurosu | B41J 2/1623 347/44 |
| 2013/0342614 | A1* | 12/2013 | Nakamura | B41J 2/14274 347/71 |
| 2016/0288502 | A1* | 10/2016 | Iijima | B41J 2/14088 |

* cited by examiner

LIQUID EJECTION HEAD AND METHOD OF MANUFACTURING LIQUID EJECTION HEAD

BACKGROUND OF THE DISCLOSURE

Field of the Disclosure

The present disclosure relates to a liquid ejection head capable of ejecting a liquid such as ink and a method of manufacturing the liquid ejection head.

Description of the Related Art

Japanese Patent Laid-Open No. 2005-178364 discloses a technique for inkjet print heads, which eject ink, to capture dust in the ink by providing a filter comprising through-holes smaller in diameter than ink ejection ports. Specifically, the above filter is disposed between a substrate on and in which are formed heating elements and an ink supply port, and a coating resin layer in which are formed ink ejection ports and an ink channel connecting the ink ejection ports and the ink supply port, and this filter is used to capture foreign substances in the ink.

SUMMARY OF THE DISCLOSURE

In the first aspect of the present disclosure, there is provided a liquid ejection head comprising:

a substrate comprising a supply port through which to supply a liquid and an element configured to produce energy for ejecting the liquid;

a resin layer comprising an ejection port through which the liquid is ejectable with the energy produced by the element, and a flow channel connecting the supply port and the ejection port;

a filter disposed between the supply port and the flow channel; and a support portion supporting a surface of the filter on the supply port side and a surface of the filter on the flow channel side.

In the second aspect of the present disclosure, there is provided a method of manufacturing a liquid ejection head comprising:

a first step of preparing a substrate comprising an element configured to produce energy for ejecting a liquid;

a second step of forming a filter on a first surface of the substrate, the filter comprising a plurality of through-holes;

a third step of forming a hole portion in the filter;

a fourth step of forming a supply port in the substrate such that the supply port communicates with the hole portion, and filling a filling member into the supply port;

a fifth step of forming a first resin layer on the filter, and forming a first pattern for forming a support portion by using the hole portion and shaping the first resin layer and the filling member, the support portion being a portion that supports both a surface of the filter on the supply port side and a surface of the filter opposed to the surface; and a sixth step of forming a second resin layer by covering the first resin layer with a resin material and causing the resin material to flow into the first pattern, forming an ejection port through which to eject the liquid in the second resin layer at a position aligned with the element, and forming the support portion by removing the first resin layer and the filling member.

Further features of the present disclosure will become apparent from the following description of exemplary embodiments with reference to the attached drawings.

DESCRIPTION OF THE EMBODIMENTS

In such an inkjet print head, the loss of pressure on the ink passing through the filter needs to be reduced in order to supply an ink amount necessary for ink ejection. To this end, the thickness of the filter may be reduced since the thickness of the filter greatly affects the pressure loss. However, reducing the film thickness of the filter decreases the mechanical strength of the filter. Consequently, the filter may possibly be deformed and broken by abrupt ink flow during capture of foreign substances in the ink and recovery actions. Meanwhile, due to the progress in printing techniques in recent years, inkjet print heads have been demanded to be longer in length and more durable. In a case where an inkjet print head is constructed to be longer in length, the area of its filter increases, thereby increasing the load on the filter and thus decreasing its durability.

Note that Japanese Patent Laid-Open No. 2005-178364 discloses a configuration in which the surface of the filter on the ink channel side is supported by a support portion in order to prevent breakage of the filter. However, the filter is supported only from above in the configuration described in Japanese Patent Laid-Open No. 2005-178364. In this case, problems such as deformation and breakage of the filter may possibly occur depending on the structure of the inkjet print head or the ink flow.

The present disclosure provides a liquid ejection head capable of preventing deformation and breakage of a filter and a method of manufacturing the liquid ejection head.

An example of a liquid ejection head and a method of manufacturing the same according to an embodiment of the present disclosure will be specifically described below with reference to the accompanying drawings.

Figure 1A:
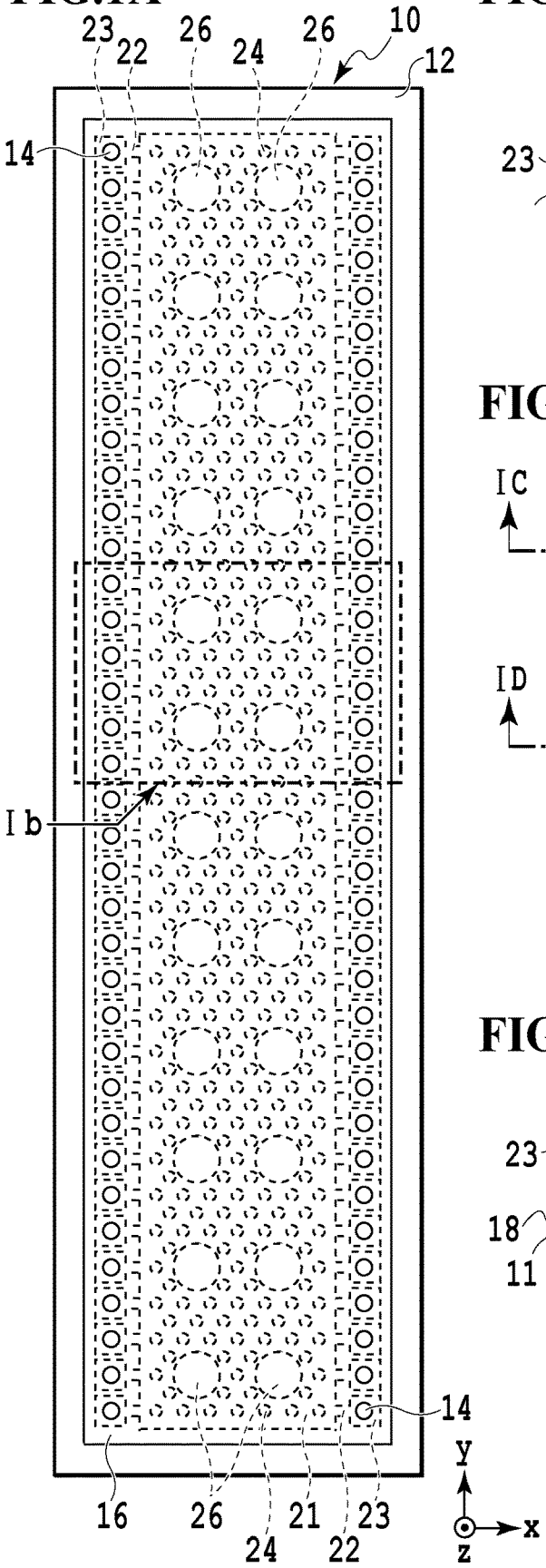
FIGS. 1A, 1B, 1C, and 1D are diagrams schematically explaining the configuration of a liquid ejection head.
Figure 1C:
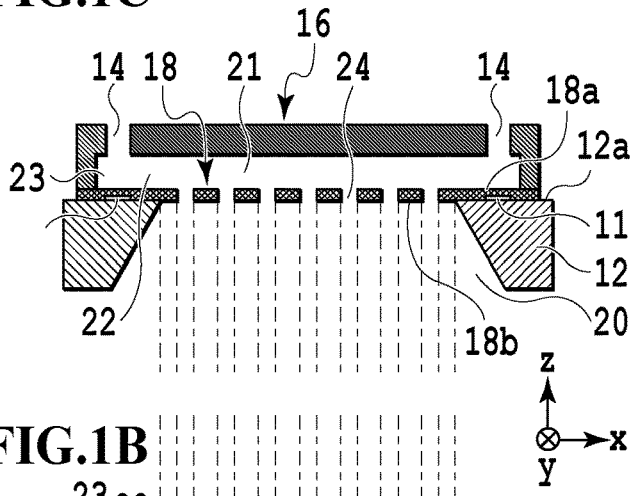
Figure 1B:
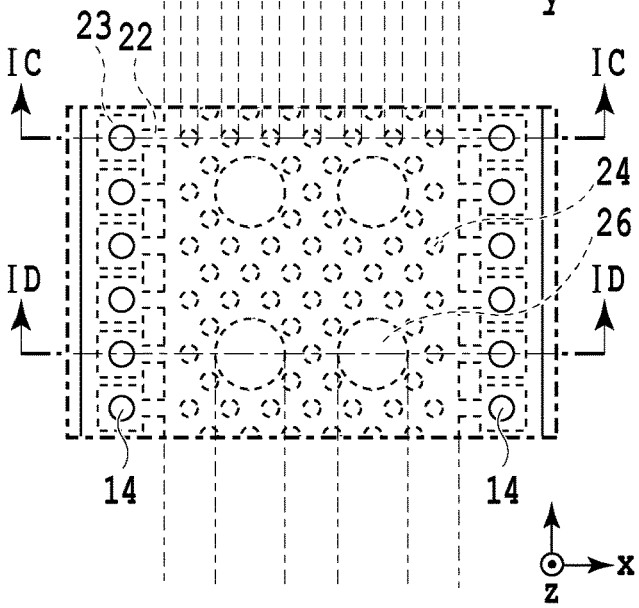
Figure 1D:
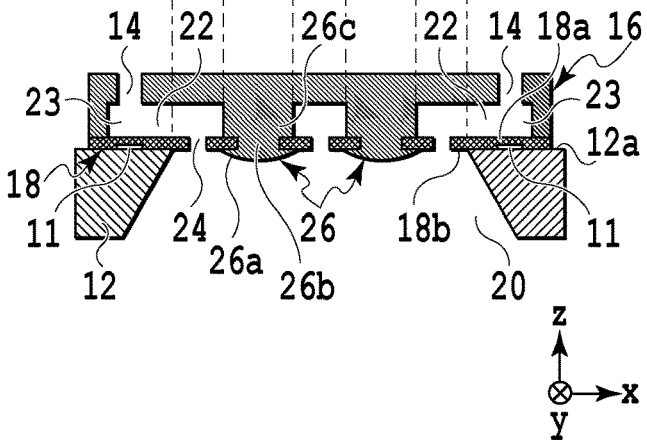

FIG. 1A is a plan view of the liquid ejection head. FIG. 1B is an enlarged view of a part of FIG. 1A. FIG. 1C is an end view of a cross section along line IC-IC in FIG. 1B. FIG. 1D is an end view of a cross section along line ID-ID in FIG. 1B.

A liquid ejection head 10 illustrated in FIG. 1A can be used as an inkjet print head, which ejects ink, for example. The liquid ejection head 10 comprises a substrate 12 provided with ejection energy production elements 11 and a drive circuit (not illustrated) for driving the ejection energy production elements 11. The liquid ejection head 10 also comprises a nozzle layer 16 with ejection ports 14 formed therein through which a liquid can be ejected, and a filter 18 provided between the substrate 12 and the nozzle layer 16.

The substrate 12 is, for example, a wafer made of monocrystalline silicon with crystal orientation (100). The substrate 12 is shaped in a substantially rectangular plate shape extending in a Y direction. In the substrate 12 is formed a common supply port 20 (supply port) through which to supply the liquid to a common flow channel 21. The common supply port 20 extends in the Y direction substantially in the center of the substrate 12 in an X direction, which is perpendicular to the Y direction. The common supply port 20 is a common port for a plurality of pressure chambers 23 to supply the liquid thereto through the common flow channel 21. This common supply port 20 is formed, for example, by a method such as anisotropic etching of the monocrystalline silicon with an alkaline solution or dry etching such as plasma etching using a gas such as a fluorocarbon-based gas or a chlorine-based gas.

The ejection energy production elements 11 are disposed on one surface 12*a* (first surface) of the substrate 12 at its opposite end portions in the X direction at certain intervals along the Y direction. Note that elements such as heating elements or piezoelectric elements can be used as the ejection energy production elements 11. At least one ejection energy production element 11 may be provided on the substrate 12 in accordance with the usage of the liquid ejection head 10.

The nozzle layer 16 (resin layer) comprises the common flow channel 21, which communicates with the common supply port 20, formed in the substrate 12, through through-holes 24 (described later) formed in the filter 18. The nozzle layer 16 also comprises the pressure chambers 23, which eject the liquid from the ejection ports 14 by using pressure produced by the ejection energy production elements 11. The pressure chambers 23 are provided for the ejection energy production elements 11 in a one-to-one correspondence. Each pressure chamber 23 communicates with the common flow channel 21 through a liquid flow channel 22. In other words, in the present embodiment, the common flow channel 21, the liquid flow channels 22, and the pressure chambers 23 function as flow channels connecting the common supply port 20 and the ejection ports 14.

In this configuration, the liquid is supplied from the common supply port 20 to the common flow channel 21 through the filter 18. The liquid supplied to the common flow channel 21 is then supplied to each pressure chamber 23 through the corresponding liquid flow channel 22. Then, the liquid inside the pressure chamber 23 receives pressure from the corresponding ejection energy production element 11, so that the liquid is ejected from the corresponding ejection port 14.

The filter 18 is a membrane filter. In the filter 18 are formed the plurality of through-holes 24, which are smaller in diameter than the ejection ports 14. For this reason, when the liquid at the common supply port 20 flows into the common flow channel 21 through the through-holes 24, foreign substances in the liquid larger than the diameter of the through-holes 24 cannot pass through the through-holes 24. As a result, these foreign substances are captured by the filter 18. By changing the diameter of the through-holes 24 on the basis of characteristics of the liquid to be ejected or the like, it is possible to selectively capture foreign substances and hence maintain the quality of the liquid ejection.

For the constituent material of the filter 18, it is possible to use an organic material or inorganic material that is highly adhesive to the substrate 12 and the nozzle layer 16 and resistant to the liquid to be ejected. Specifically, it is possible to use a photo-setting resin or a thermosetting resin, for example. As for the method of forming the filter 18, it is possible to use a method such as chemical vapor deposition (CVD) or physical vapor deposition (PVD) in the case where the filter 18 is an inorganic film.

The method of forming the through-holes 24 varies depending on the constituent material of the filter 18. In the case where the filter 18 is made, for example, of a photo-setting resin, the through-holes 24 are formed in the filter 18 by photolithography. On the other hand, in the case where the filter 18 is made, for example, of a resin material other than photo-setting resins, firstly a film is formed from this resin material, and an etching mask is formed on this film. Then, the through-holes 24 are formed by dry etching or wet etching. Further, in the case where the filter 18 is formed, for example, from an inorganic material or the like, the through-holes 24 are formed by performing laser processing or the like on the formed filter 18.

As illustrated in FIG. 1D, the filter 18 is supported by support portions 26 extending from the nozzle layer 16. These support portions 26 are made of the same material as the material of the nozzle layer 16 and are formed integrally with the nozzle layer 16. Note that the support portions 26 may be made of a material different from the material of the nozzle layer 16 or formed as separate bodies from the nozzle layer 16. The support portions 26 reinforce the mechanical strength of the filter 18.

The support portions 26 are formed to extend from the nozzle layer 16 and penetrate through the filter 18. Specifically, the support portions 26 are formed to extend through the common flow channel 21 and penetrate through the filter 18 and their tip portions 26*a* are positioned inside the common supply port 20. While the support portions 26 have a substantially cylindrical shape in the present embodiment, their shape is not limited to a substantially cylindrical shape. Two support portions 26 are provided spaced from each other in the X direction substantially at the center of the common supply port 20 in the X direction. Note that depending, for example, on the length of the common supply port 20 in the X direction and the diameter of the support portions 26, one or three or more support portions 26 may be provided in the X direction substantially at the center of the common supply port 20 in the X direction. Also, a plurality of support portions 26 are provided at certain intervals in the Y direction, along which the common supply port 20 extends.

The tip portion 26*a* of each support portion 26 is larger in diameter than a penetrating portion 26*b* of the support portion 26 penetrating through the filter 18. Further, the tip portion 26*a* adheres tightly to a surface 18*b* of the filter 18 in abutment with the common supply port 20. Also, an extending portion 26*c* of each support portion 26 positioned in the common flow channel 21 (in the flow channel) is larger in diameter than the penetrating portion 26*b*. Further, the extending portion 26*c* adheres tightly to a surface 18*a* of the filter 18 in abutment with the common flow path 21. With this configuration of the support portions 26, the filter 18 is supported by the support portions 26 from both the surface on the common supply port 20 side (supply port side) and the surface on the common flow channel 21 side (flow channel side).

The diameters of the tip portion 26*a*, the penetrating portion 26*b*, and the extending portion 26*c* may be larger than the diameter of the through-holes 24 or equal to or smaller than the diameter of the through-holes 24. Also, the difference in diameter between the extending portion 26*c* and the penetrating portion 26*b* and the difference in diameter between the tip portion 26*a* and the penetrating portion 26*b* may be equal to each other, or one may be larger than the other. By setting the diameters of the extending portion 26*c* and the tip portion 26*a* relative to the diameter of the penetrating portion 26*b* on the basis of the mechanical strength of the filter 18, it is possible to reliably improve the mechanical strength of the filter 18.

The filter 18 is subjected to a large load due to abrupt ink flow during capture of foreign substances and recovery actions. However, the filter 18 is supported by the support portions 26 from both the surface on the common supply port 20 side and the surface on the common flow channel 21 side. For this reason, even when a large load is applied to the filter 18, the filter 18 is prevented from being detached from the support portions 26 and is reliably supported by the support portions 26. Accordingly, the high reinforcing effect on the filter 18 by the support portions 26 can be maintained for a long time.

FIGS. 2A to 2E and FIGS. 3A to 3E are diagrams for explaining an example of a process of manufacturing the liquid ejection head 10. Note that each of FIGS. 2A to 2E and FIGS. 3A to 3E is an end view of a cross section at a position at which ejection ports 14, through-holes 24, and support portions 26 are positioned along the X direction, as in FIG. 1D. Also, to facilitate the understanding, two through-holes 24 are provided at the above position. Further, illustration of the ejection energy production elements provided at the positions facing the ejection ports 14 is omitted. Furthermore, to facilitate the understanding, each constituent member is given a different pattern.

Figure 2A:
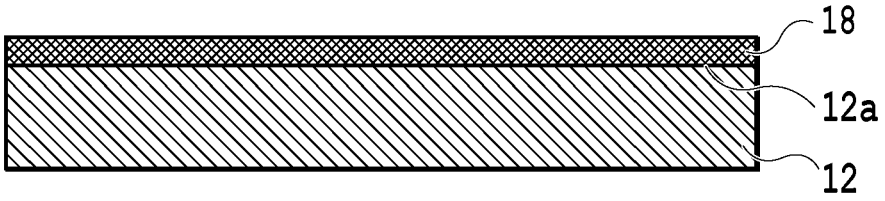
FIGS. 2A, 2B, 2C, 2D, and 2E are diagrams for explaining a process of manufacturing the liquid ejection head.
Figure 2B:
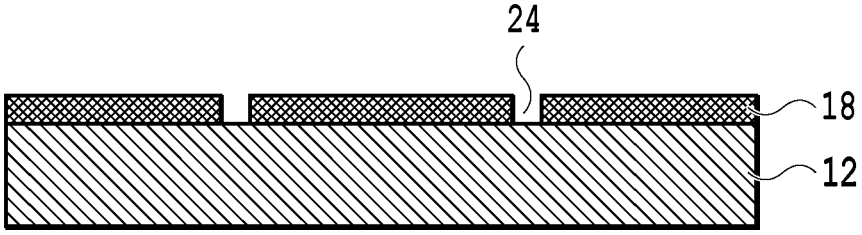

In the process of manufacturing the liquid ejection head 10, first, a silicon wafer is prepared in which are formed ejection energy production elements and a drive circuit for driving the ejection energy production elements. This wafer is a wafer made of monocrystalline silicon with crystal orientation (100) and measuring 200 mm in diameter and 725 μm in thickness (length in a Z direction), for example. Note that since this wafer will be the substrate 12, the wafer will be referred to as the substrate 12 as appropriate in the following description. Then, as illustrated in FIG. 2A, a resin layer, made of a resin material, is formed on the one surface 12*a* of the substrate 12 by spin coating. Note that the one surface 12*a* is a (100) plane. Also, since this resin layer will be the filter 18, the resin layer will be referred to as the filter 18 as appropriate in the following description. In one specific example, HL-1200CH (manufactured by Hitachi Chemical Co., Ltd.) is used as the resin material, and the number of spins is adjusted such that the film thickness of the filter 18, which is the resin layer, is 3 μm.

Thereafter, an etching mask is formed on the filter 18 by using a positive photoresist. For example, first, a positive photoresist PMER (manufactured by TOKYO OHKAKOGYO CO., LTD.) is applied onto the filter 18 by spin coating to form a coating film with a film thickness of 10 μm on the filter 18 (on the filter). Then, proximity exposure is performed on the formed coating film by using a mask pattern in which the through-holes 24 are depicted, and an etching mask is formed by using a 2.38% tetramethylammonium hydroxide (TMAH) aqueous solution. Then, the through-holes 24 are formed by reactive ion etching (RIE) mainly using a fluorocarbon-based gas (see FIG. 2B). Specifically, the through-holes 24 are formed by using a mixture gas of a fluorocarbon-based gas CF4 and oxygen, and the etching mask is stripped off by using a stripping liquid.

Figure 2C:
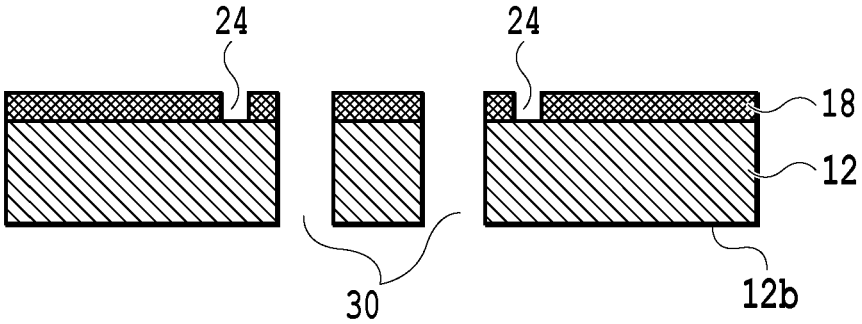

After forming the through-holes 24 in the filter 18, a penetrating pattern 30 is formed which penetrates through the substrate 12 and the filter 18 (see FIG. 2C). The penetrating pattern 30 is formed, for example, by applying a Nd-YAG laser beam from the other surface 12*b* (second surface) of the substrate 12. Note that a general silicon processing method may be used as the method of forming the penetrating pattern 30. For example, semiconductor dry etching, such as RIE, can be used instead.

Figure 2D:
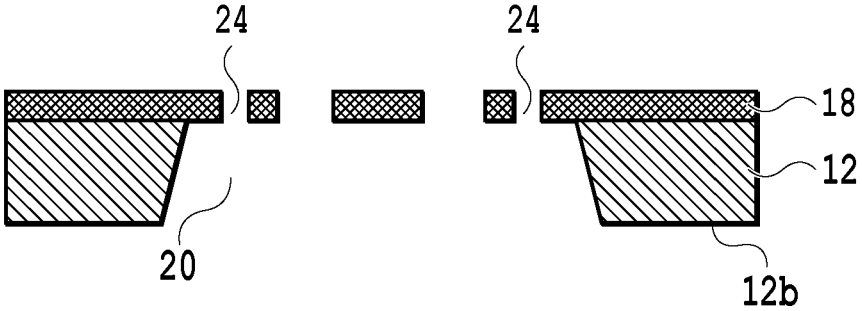

After forming the penetrating pattern 30, the common supply port 20 is formed in the substrate 12 (see FIG. 2D). For example, the common supply port 20 is formed in the substrate 12 by anisotropic etching of the monocrystalline silicon with a hot alkaline aqueous solution. For example, an aqueous solution of TMAH at a mass concentration of 25% heated to 80° C. is used as the hot alkaline aqueous solution, and the etching duration is approximately 4 hours. An aqueous solution such as a KOH aqueous solution or a NaOH aqueous solution may be used as the hot alkaline aqueous solution if alkali metal contamination or the like is unlikely. Note that a coating film is provided on the substrate 12 to protect the element portions of the substrate 12 during the anisotropic etching. For example, a negative photoresist OMR (manufactured by TOKYO OHKA KOGYO CO., LTD.) is applied to a thickness of 30 μm. After the anisotropic etching, the coating film, which is no longer needed, is removed by dissolving it with xylene or the like.

In the present embodiment, the penetrating pattern 30 is formed prior to the anisotropic etching for forming the common supply port 20. In this way, the area of contact between the substrate 12 and the hot alkaline aqueous solution is larger, thereby shortening the duration of the etching of the substrate 12 with the etching solution (hot alkaline aqueous solution). Note that the method of forming the common supply port 20 may be such that only hole portions 34 (described later) are formed, a metal mask or the like is formed on the other surface 12*b* of the substrate 12, and the common supply port 20 is formed only by etching with an etching solution.

Figure 2E:
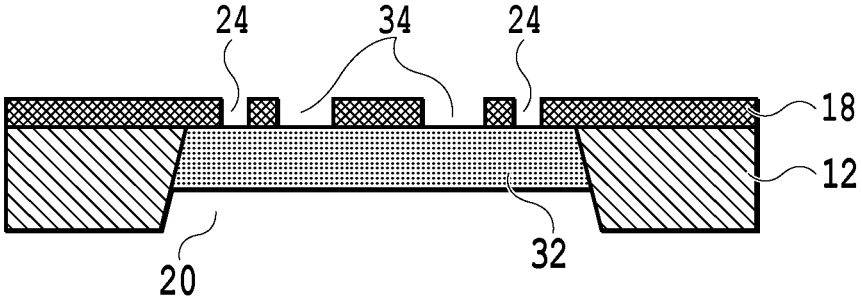

Next, as illustrated in FIG. 2E, a filling member 32 is filled in the common supply port 20. In this step, the filling member 32 is caused to flow into neither the through-holes 24 nor the hole portions 34, formed by the formation of the penetrating pattern 30. The filling member 32 is formed by using, for example, a polyvinyl alcohol (PVA) aqueous solution with 3000 cp. A dispensing method can be used to fill the filling member 32 into the common supply port 20. After the filling, a baking process is performed on the filling member 32 under a condition of, for example, a temperature of 90° C. and a duration of 3 minutes to vaporize moisture and thereby cure the PVA. The thickness (length in the Z direction) of the cured filling member 32 in the common supply port 20 is, for example, 100 μm. Note that the thickness of the cured filling member 32 may be less than 100 μm or more than 100 μm.

Figure 3A:
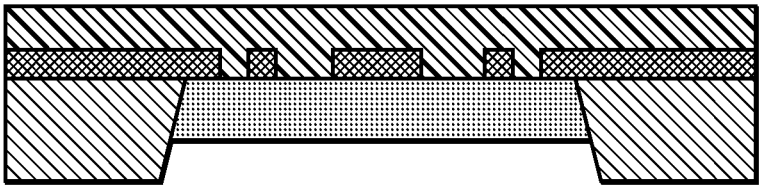
FIGS. 3A, 3B, 3C, 3D, and 3E are diagrams for explaining the process of manufacturing the liquid ejection head.

As illustrated in FIG. 3A, after the filling member 32 is filled, a resin layer 36 (first resin layer), made of a resin material, is formed on the filter 18 by spin coating. Specifically, for example, a positive photoresist ODUR (manufactured by TOKYO OHKA KOGYO CO., LTD.) is used as the resin material, and the number of spins is adjusted such that the film thickness of the resin layer 36 on the filter 18 is 17 μm. Then, a baking process is performed on the resin layer 36 under a condition of a temperature of 100° C. and a duration of 3 minutes.

Figure 3B:
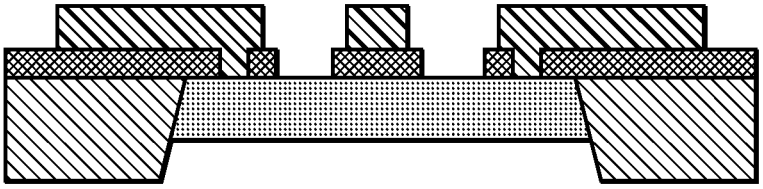

Thereafter, as illustrated in FIG. 3B, by using photolithography, the resin layer 36 is left to form a pattern 28 (second pattern) of the common flow channel 21, the liquid flow channels 22, and the pressure chambers 23, and is removed to form a pattern 29 (first pattern) of the support portions 26 (penetrating portion 26*b* and extending portion 26*c*). Specifically, since the liquid flow channels 22 communicate with the through-holes 24, the resin layer 36 (pattern 28) is left in the through-holes 24 as well. Also, the resin layer 36 in and on the hole portions 34 is removed, so that the hole portions 34 and the remaining resin layer 36 form spaces (pattern 29). In the pattern 29 of each support portion 26, a substantially cylindrical space S larger in diameter than the hole portion 34 is formed on the hole portion 34 so that the penetrating portion 26*b*, which will be positioned in the hole portion 34, will be larger in diameter than the extending portion 26*c*, which will be positioned in the common flow channel 21.

Figure 3C:
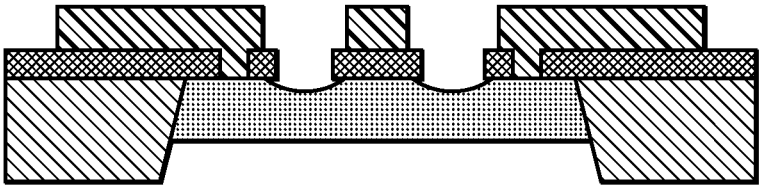

After the patterns 28 and 29 are formed, a further baking process is performed on the filling member 32 under a condition of, for example, a temperature of 120° C. and a duration of 3 minutes. As a result, the moisture in the filling member 32, i.e., the PVA, is further vaporized. As the moisture is further vaporized, the filling member 32 shrinks, so that, as illustrated in FIG. 3C, the regions in the filling member 32 in abutment with the hole portions 34 are indented to the common supply port 20 side, thereby forming recessed portions 38. Here, the diameter of the recessed portions 38 at a surface 32*a* of the filling member 32 tightly adhering to the filter 18 is larger than the diameter of the hole portions 34. These recessed portions 38 serve as a pattern of the tip portions 26*a* of the support portions 26. In other words, the pattern 29 for forming the support portions 26 is formed by using the hole portions 34 and shaping the resin layer 36 and the filling member 32. Note that the method of forming the recessed portions 38 can be changed as appropriate according to the constituent material of the filling member 32. For example, the recessed portions 38 may be formed by a method such as wet etching or dry etching.

Figure 3D:
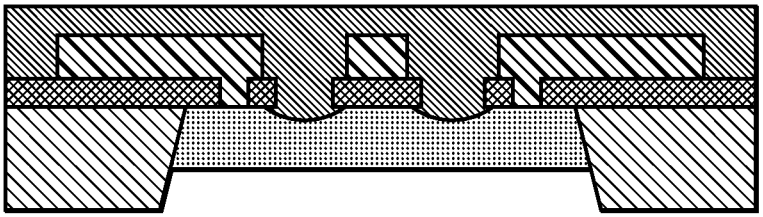
Figure 3E:
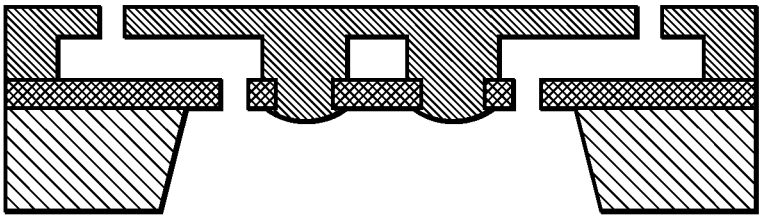

As illustrated in FIG. 3D, after the recessed portions 38 are formed, a resin layer, made of a resin material, is formed on the filter 18 by spin coating. In forming this resin layer, its resin material covers the pattern 28 and flows into the pattern 29 (including the recessed portions 38). Note that since this resin layer (second resin layer) will be the nozzle layer 16, the resin layer will be referred to as the nozzle layer 16 as appropriate in the following description. Specifically, for example, a negative photoresist SU-8 (manufactured by Kayaku MicroChem Corporation) is used as the resin material, and the number of spins is adjusted such that the film thickness of the nozzle layer 16, which is the resin layer, is 30 μm (the film thickness on the filter 18).

Then, a pre-baking process is performed on the nozzle layer 16 under a condition of, for example, a temperature of 90° C. and a duration of 5 minutes. Further, by using photolithography, the ejection ports 14 are formed so as to reach the pattern 28 at positions aligned with the ejection energy production elements 11. Then, a post-baking process is performed on the nozzle layer 16 under a condition of, for example, a temperature of 140° C. and a duration of 60 minutes. Thereafter, the pattern 28 and the filling member 32 are removed by using a processing liquid (see FIG. 3E). As a result, the nozzle layer 16, comprising the support portions 26, the common flow channel 21, the liquid flow channels 22, and the pressure chambers 23, is formed. Since the nozzle layer 16 and the support portions 26 are formed together by using photolithography, the position of the formed support portions 26 are accurate. Note that the nozzle layer 16 and the support portions 26 may be formed separately.

As described above, in the configuration of the liquid ejection head 10, in which the substrate 12 and the nozzle layer 16 adhere tightly to each other with the filter 18 therebetween, the support portions 26, supporting the filter 18, extend from the nozzle layer 16 and penetrate through the filter 18. Also, in each support portion 26, the penetrating portion 26*b*, penetrating through the filter 18, is smaller in diameter than the tip portion 26*a* and the extending portion 26*c*. In this way, the filter 18 is supported by the support portions 26 from both the surface on the common supply port 20 side and the surface on the common flow channel 21 side. Hence, the filter 18 is supported reliably as compared to the technique disclosed in Japanese Patent Laid-Open No. 2005-178364.

For this reason, in the liquid ejection head 10, the support portions 26 can prevent movement of the filter 18 due to ink flow even in the case where the mechanical strength of the filter 18 decreases due to reduction in its film thickness and the load on the filter 18 increases due to increase in length of the liquid ejection head 10. Accordingly, it is possible to achieve stable ejection performance and prevent deformation and breakage of the filter.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-127514, filed Jul. 4, 2018, which is hereby incorporated by reference wherein in its entirety.

What is claimed is:

1. A liquid ejection head comprising:

a substrate comprising a supply port through which to supply a liquid and an element configured to produce energy for ejecting the liquid;

a resin layer comprising an ejection port through which the liquid is ejectable with the energy produced by the element, and a flow channel connecting the supply port and the ejection port;

a filter disposed between the supply port and the flow channel; and a support portion supporting a surface of the filter on a supply port side and a surface of the filter on a flow channel side, wherein the support portion is formed integrally with the resin layer, and wherein the support portion extends through the flow channel from the resin layer, penetrates through the filter, and reaches the supply port.

2. The liquid ejection head according to claim 1, wherein a penetrating portion of the support portion penetrating through the filter is smaller in diameter than an extending portion of the support portion positioned in the flow channel and a tip portion of the support portion positioned in the supply port.

3. The liquid ejection head according to claim 1, wherein the support portion is made of a same material as a material of the resin layer.

4. A method of manufacturing a liquid ejection head comprising:

a first step of preparing a substrate comprising an element configured to produce energy for ejecting a liquid;

a second step of forming a filter on a first surface of the substrate, the filter comprising a plurality of through-holes;

a third step of forming a hole portion in the filter;

a fourth step of forming a supply port in the substrate such that the supply port communicates with the hole portion, and filling a filling member into the supply port;

a fifth step of:

forming a first resin layer on the filter; and forming a first pattern for forming a support portion by using the hole portion and shaping the first resin layer and the filling member, the support portion being a portion that supports both a surface of the filter on a supply port side and a surface of the filter opposed to the surface; and a sixth step of:

forming a second resin layer by covering the first resin layer with a resin material and causing the resin material to flow into the first pattern;

forming an ejection port through which to eject the liquid in the second resin layer at a position aligned with the element; and forming the support portion by removing the first resin layer and the filling member, wherein the support portion is formed to extend through the hole portion from the second resin layer, penetrate through the filter, and reach the supply port.

5. The method according to claim 4, wherein in the fifth step, a second pattern for forming a flow channel communicating with the supply port is formed on the filter by using the first resin layer, and wherein in the sixth step, the flow channel is formed along with the support portion by removing the first resin layer and the filling member.

6. The method according to claim 4, wherein in the fifth step, the filling member is shaped by shrinking the filling member.

7. The method according to claim 4, wherein in the third step, the hole portion is formed by boring through the substrate and the filter from a second surface of the substrate opposed to the first surface of the substrate.

8. The method according to claim 4, wherein a penetrating portion of the support portion penetrating through the filter is smaller in diameter than an extending portion of the support portion extending from the second resin layer and a tip portion of the support portion positioned in the supply port.

* * * * *